US008597061B2

(12) United States Patent
Liang et al.

(10) Patent No.: US 8,597,061 B2
(45) Date of Patent: Dec. 3, 2013

(54) EARPHONE PLUG WITH SWITCH DEVICE

(75) Inventors: Yu-Lan Liang, Taichung (TW); Ching-Wen Chang, Taichung (TW); Chiu-Yun Tung, Taichung (TW)

(73) Assignee: Merry Electronics Co., Ltd., Taichung (TW)

( * ) Notice: Subject to any disclaimer, the term of this patent is extended or adjusted under 35 U.S.C. 154(b) by 331 days.

(21) Appl. No.: 12/986,819

(22) Filed: Jan. 7, 2011

(65) Prior Publication Data

US 2012/0178296 A1 Jul. 12, 2012

(51) Int. Cl.
*H01R 24/00* (2011.01)

(52) U.S. Cl.
USPC ..... 439/669; 200/51.05; 381/74

(58) Field of Classification Search
USPC ..... 439/669; 381/74; 200/51.03, 51.04, 200/51.05, 51.06
IPC ..... H01R 24/58
See application file for complete search history.

(56) References Cited

U.S. PATENT DOCUMENTS

| | | | | |
|---|---|---|---|---|
| 6,979,231 | B2 * | 12/2005 | Shinohara | 439/669 |
| 7,618,294 | B1 * | 11/2009 | Lin et al. | 439/669 |
| 2011/0026755 | A1 * | 2/2011 | Wu et al. | 381/384 |
| 2012/0128169 | A1 * | 5/2012 | Tung et al. | 381/74 |

* cited by examiner

*Primary Examiner* — Vanessa Girardi
(74) *Attorney, Agent, or Firm* — Muncy, Geissler, Olds & Lowe, PLLC

(57) ABSTRACT

An earphone plug applicable to different system specifications includes a terminal and a switch device. The earphone plug is inserted into an earphone jack of an external electronic device for transmitting signals by a plurality of exposed signal interfaces of the terminal. The switch device combined with the terminal has a first conductor and a second conductor. When the switch device is switched between a first mode and a second mode, the first conductor and the second conductor alternately contact with two of the signal interfaces. Thus, the signal transmission defined by the signal interfaces is changed and the earphone plug is applicable to electronic devices with different system specifications.

14 Claims, 6 Drawing Sheets

EARPHONE PLUG WITH SWITCH DEVICE

BACKGROUND OF THE INVENTION

1. Field of Invention

The present invention relates to an earphone plug, and more particularly to an earphone plug that is applicable to both system specifications of Open Mobile Terminal Platform (OMTP) and American Telephone and Telegraph (AT&T) by using a mechanical member to alternately switch signal interfaces of the plug.

2. Related Art

Currently an earphone is one of the indispensable parts for portable electronic products (such as, a mobile phone, a MP3 player, and a PDA). The earphone includes an earphone plug adapted to receive electronic signals, and a loudspeaker adapted to convert the electronic signals into acoustic signals. In recent years, with the rapid popularization of the mobile phone, if a user intends to use the hand-free handset function of the mobile phone, a microphone is required to add to the earphone, so as to achieve the purposes of safety and convenience in communication. Currently, the most common earphone plugs may be divided into a three-electrode mode and a four-electrode mode. The three-electrode mode is mainly used in a monophonic earphone and the four-electrode mode is applicable to a stereophonic earphone. Each electrode on the terminal of the earphone is a signal interface, which can interactively transmit electronic signals with an electronic product through the earphone jack connected with the electronic product.

FIG. 1 is a schematic view of the appearance of a conventional earphone plug. Referring to FIG. 1, the earphone plug is a currently common four-electrode earphone plug 10, and includes four signal interfaces, A1, A2, A3 and A4, which are respectively adapted to transmit left channel signals, right channel signals, microphone signals, and grounding signals. The definition of the interface is in conformity with the specification of an OMTP system, in which the OMTP is an open mobile terminal platform established by several major mobile network manufacturers worldwide (Vodafone, Orange, T-Mobile, mmO2, Telefonica, "Telecom Italia Mobile", NTT) and is intended to put forward suggestions as reference for the design of a mobile phone so as to exert an influence on major mobile phone suppliers such as Nokia, Samsung Electronics, Motorola, and Sony Ericsson.

However, except for the above OMTP system, the signal interfaces A1, A2, A3, A4 of the earphone plug currently still can be configured in another manner, that is, the signal interface A1 transmits the left channel signals; the signal interface A2 transmits the right channel signals; the signal interface A3 transmits the grounding signals, and the signal interface A4 transmits the microphone signals. The configuration manner belongs to an AT&T system.

The above two system configurations are still prevalent in the earphone jacks and earphone plugs of many mobile phones. Thus, if a consumer inserts an earphone plug of the OMTP system into an earphone jack of the AT&T system, some sounds are eliminated, that is, the function cannot be fully performed. Thus, for the user, the safest is to use the accompanying earphone provided by the mobile phone manufacturer. However, in fact, the users always hope that their earphones can be applicable to different mobile phones; in other words, the earphones can be applicable to different system specifications. That is, no matter what type of earphone jack is encountered, the earphone plug can insert into without degrading functional performances, such as music transmission and voice transmission functions.

Thus, in order to meet the requirement of the user that a single part should be applicable to multiple products, it is necessary to improve the conventional design of the earphone plug.

SUMMARY OF THE INVENTION

Accordingly, the present invention is directed to an earphone plug applicable to different system specifications, in which signal interfaces of the earphone plug are alternately switched by rotating a structural member on the plug so as to be applicable to both OMTP and AT&T system specifications.

To achieve the above objectives, an earphone plug applicable to different system specifications according to the present invention comprises a terminal and a switch device. The terminal has a plurality of signal interfaces thereon that are respectively adapted to transmit signals. The switch device is combined with the terminal, and has a first conductor and a second conductor thereon. When the switch device is switched between a first mode and a second mode, the first conductor and the second conductor alternately contact with two of the signal interfaces.

To achieve the above objectives, in the earphone plug applicable to different system specifications according to the present invention, the signal interfaces of the terminal are respectively adapted to transmit left channel signals, right channel signals, microphone signals, and grounding signals. The first conductor and the second conductor alternately contact with the two signal interfaces responsible for transmitting the microphone signals and the grounding signals, and allow the signal interfaces on the terminal to transmit signals in a different order. Thus, the earphone plug is applicable to both system specifications of OMTP and AT&T.

Compared with the prior art, the earphone plug according to the present invention takes advantage of the two conductors of the switch device disposed on the terminal which alternately contact with two signal interfaces and allow the signal interfaces on the terminal to transmit signals in a different order. Thus, the earphone plug is compatible with earphone jacks of both OMTP and AT&T systems and applicable to mobile phones with different systems, so that functions such as music transmission and voice transmission can be effectively performed.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE EMBODIMENTS

An earphone plug applicable to different system specifications according to preferred embodiments of the present invention is described hereinafter with reference to relevant drawings.

Figure 1:
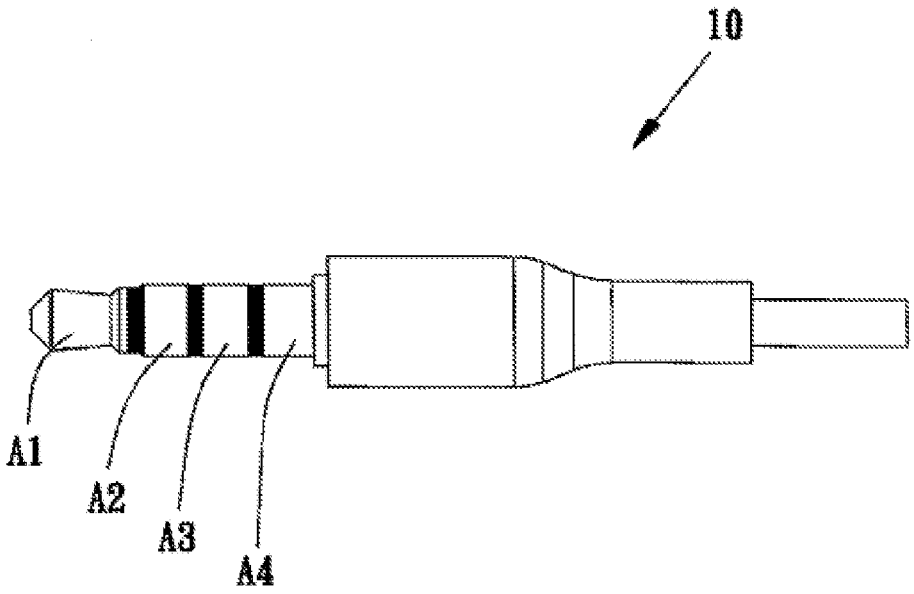
FIG. 1 (Prior Art)
FIG. 1 is a schematic appearance view of a conventional earphone plug.
Figure 2:
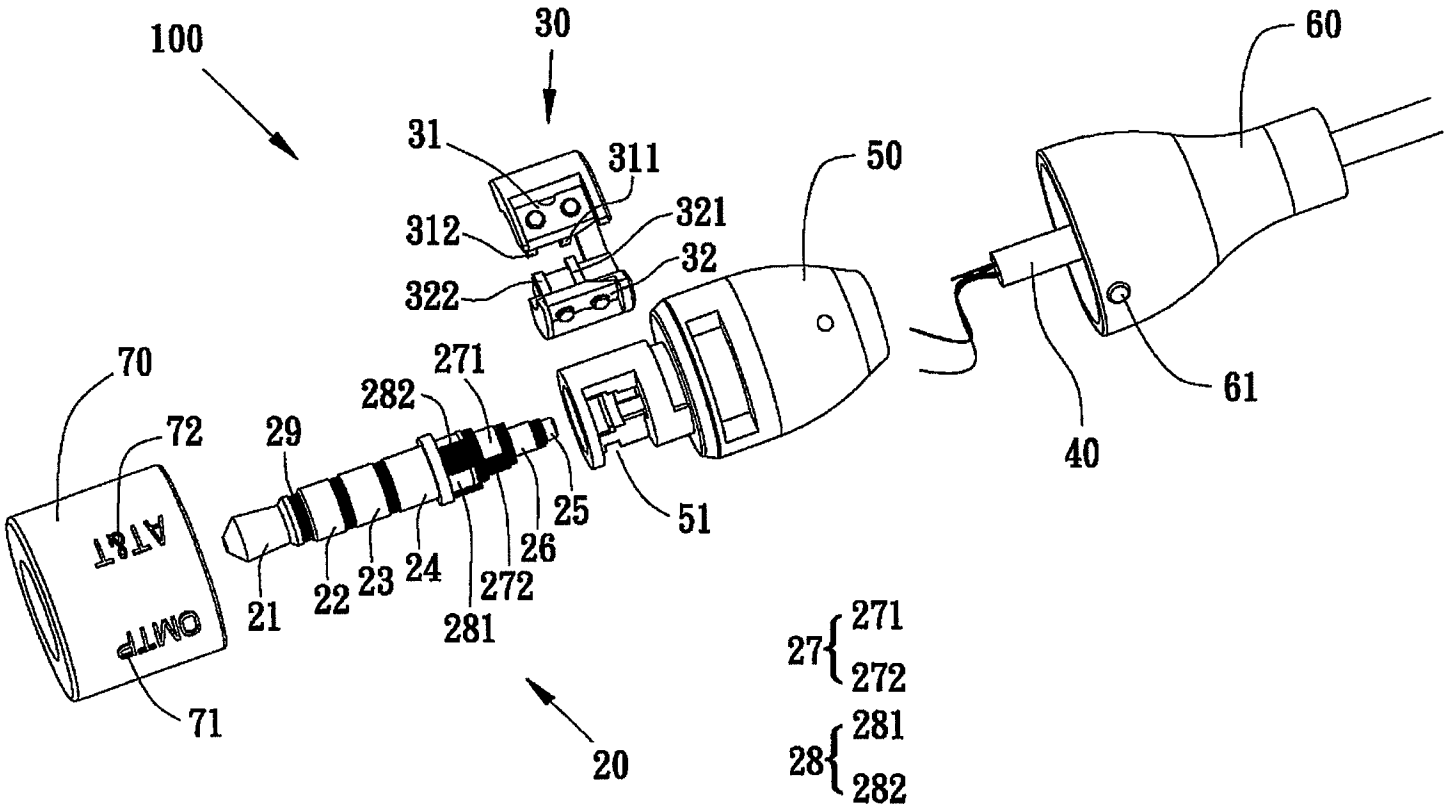
FIG. 2 is a three-dimensional exploded view of an earphone plug according to the present invention.
Figure 3:
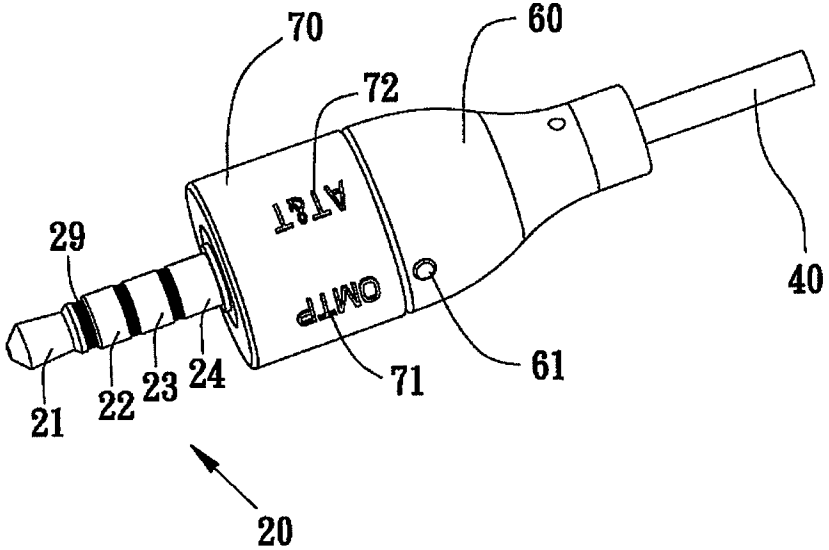
FIG. 3 is a schematic appearance view of the earphone plug according to the present invention, in which a switch sleeve is switched to a first mode.

Referring to FIG. 2 and FIG. 3, an earphone plug 100 according to the present invention includes a terminal 20 and a switch device 30. The earphone plug 100 is inserted into an earphone jack of an external electronic device for transmitting signals by a plurality of exposed signal interfaces 21, 22, 23 and 24 of the terminal 20. A switch device 30 is combined with the terminal 20, and has a first conductor 31 and a second conductor 32. When the switch device 30 is switched between a first mode and a second mode, the first conductor 31 and the second conductor 32 alternately contact with two of the signal interfaces 21, 22, 23 and 24. Thus, the signal transmission defined by the signal interfaces 21, 22, 23 and 24 is changed, and the earphone plug is applicable to electronic devices with different system specifications.

As shown in FIG. 3, the earphone plug 100 according to the present invention further includes a wire assembly 40, an internal module 50, an external module 60, and a switch sleeve 70. The wire assembly 40 is electrically connected to the terminal 20, the internal module 50 is sleeved on the terminal 20 and the wire assembly 40, the switch device 30 is sleeved on the internal module 50, and the external module 60 and the switch sleeve 70 are respectively sleeved on the internal module 50 from two ends of the internal module 50 so as to be combined with the internal module 50.

In the drawings, the terminal 20 has a group of external signal interfaces and a group of internal signal interfaces. The external signal interfaces include a first signal interface 21, a second signal interface 22, a third signal interface 23, and a fourth signal interface 24; and the internal signal interfaces may include a first signal interface 25, a second signal interface 26, a third signal interface 27, and a fourth signal interface 28. The above signal interfaces are isolated with each other by an insulation area 29. It should be noted that in the internal structure of the terminal 20, the first signal interface 21 of the external signal interfaces is electrically connected to the first signal interface 25 of the internal signal interfaces, and other external interfaces and internal interfaces are correspondingly connected to each other.

The above third signal interface 27 of the internal signal interfaces has a conduction area 271 and an insulation area 272 thereon, and the fourth signal area 28 also has a conduction area 281 and an insulation area 282 thereon. As the insulation areas 272 and 282 are added, the conduction areas 271 and 281 become smaller. According to an interlacing design of the insulation areas 272 and 282, the conduction areas 271 and 281 are also interlaced.

In the drawings, the first conductor 31 of the switch device 30 further includes a first pin 311 and a second pin 312; the second conductor 32 also includes a third pin 321 and a fourth pin 322. The first pin 311 and the third pin 321 correspondingly contact against the third signal interface 27 of the terminal 20; the second pin 312 and the fourth pin 322 correspondingly contact against the fourth signal interface 28 of the terminal 20.

In the drawings, the wire assembly 40 has four wires which are electrically connected to the first signal interfaces 21 (25), the second signal interfaces 22 (26), the first conductor 31, and the second conductor 32 respectively.

In the drawings, one end of the internal module 50 wraps the internal signal interfaces of the terminal 20, and the other end is provided for the wire assembly 40 to pass through to be electrically connected to the terminal 20. An opening 51 is disposed on the part of the internal module 50 wrapping the terminal 20, and thus the third signal interface 27 and the fourth signal interface 28 of the internal signal interfaces are exposed. When the ring-shaped switch device 30 is sleeved on the internal module 50, the first conductor 31 and the second conductor 32 may contact with the third signal interface 27 and the fourth signal interface 28 through the opening 51.

In the drawings, the external module 60 and the switch sleeve 70 are sleeved on the internal module 50 from opposite sides. The wire assembly 40 extends from the end of the external module 60, and the switch sleeve 70 is combined with the switch device 30 when being sleeved on the internal module 50. A reference point 61, such as a notch or a mark, is disposed on the external module 60, and a first mode mark 71 and a second mode mark 72 are marked on the switch sleeve 70. For example, when the first mode mark 71 is OMTP and the second mode mark 72 is AT&T. If the switch sleeve 70 is rotated to correspond the mark "OMTP" to the reference point 61, the earphone plug 100 is in the first mode, that is, the earphone plug is applicable to the OMTP system; and if the switch sleeve 70 is rotated to correspond the mark "AT&T" to the reference point 61, the earphone plug 100 is in the second mode, that is, the earphone plug is applicable to the AT&T system.

Referring to FIG. 3 to FIG. 6, relation between the switch device 30 and the terminal 20 is hereinafter described in detail when the mode is switched.

Figure 4:
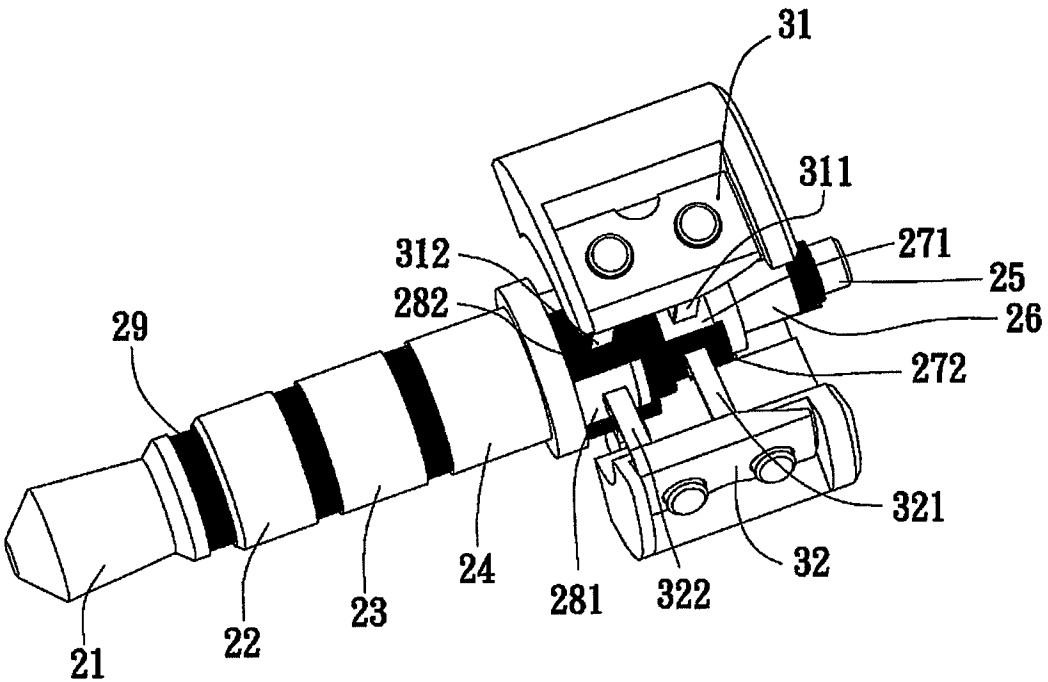
FIG. 4 is a schematic view of relative positions of a switch device and a terminal when the earphone plug according to the present invention is in the first mode.

In the OMTP mode according to FIG. 3 and FIG. 4, the first signal interface 21 of the terminal 20 is electrically connected to the wire for transmitting the left channel signals in the wire assembly 40, the second signal interface 22 is electrically connected to the wire for transmitting the right channel signals in the wire assembly 40, the first conductor 31 is electrically connected to the wire for transmitting the microphone signals in the wire assembly 40, and the second conductor 32 is electrically connected to the wire for transmitting the grounding signals in the wire assembly 40.

In this mode, the first pin 311 of the first conductor 31 contacts with the conduction area 271 of the third signal interface 27, the second pin 312 contacts with the insulation area 282 of the fourth signal interface 28, the third pin 321 of the second conductor 32 contacts with the insulation area 272 of the third signal interface 27, and the fourth pin 322 contacts with the conduction area 281 of the fourth signal interface 28. Therefore, the first signal interface 21, the second signal interface 22, the third signal interface 23, and the fourth signal interface 24 in the external signal interfaces are respectively provided for transmitting the left channel signals, the right channel signals, the microphone signals, and the grounding signals, and thus the earphone plug is applicable to products of the OMTP system.

Figure 5:
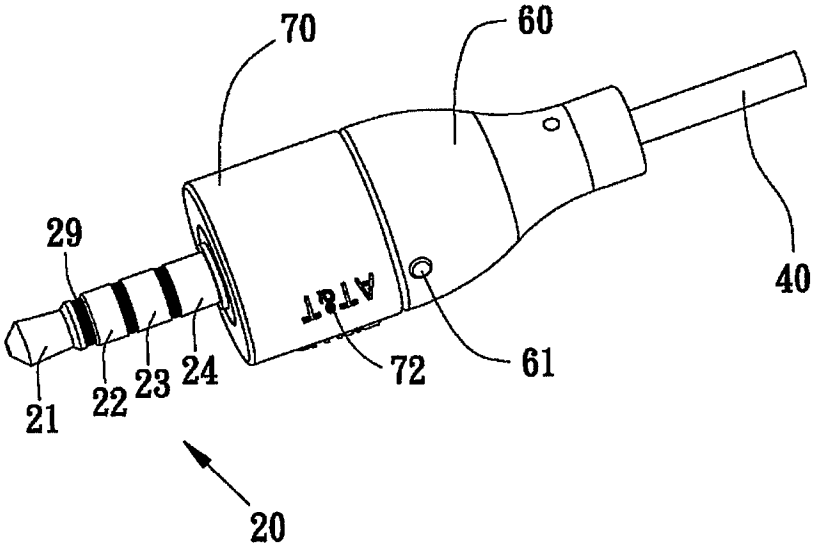
FIG. 5 is a schematic appearance view of the earphone plug according to the present invention, in which the switch sleeve is switched to a second mode.
Figure 6:
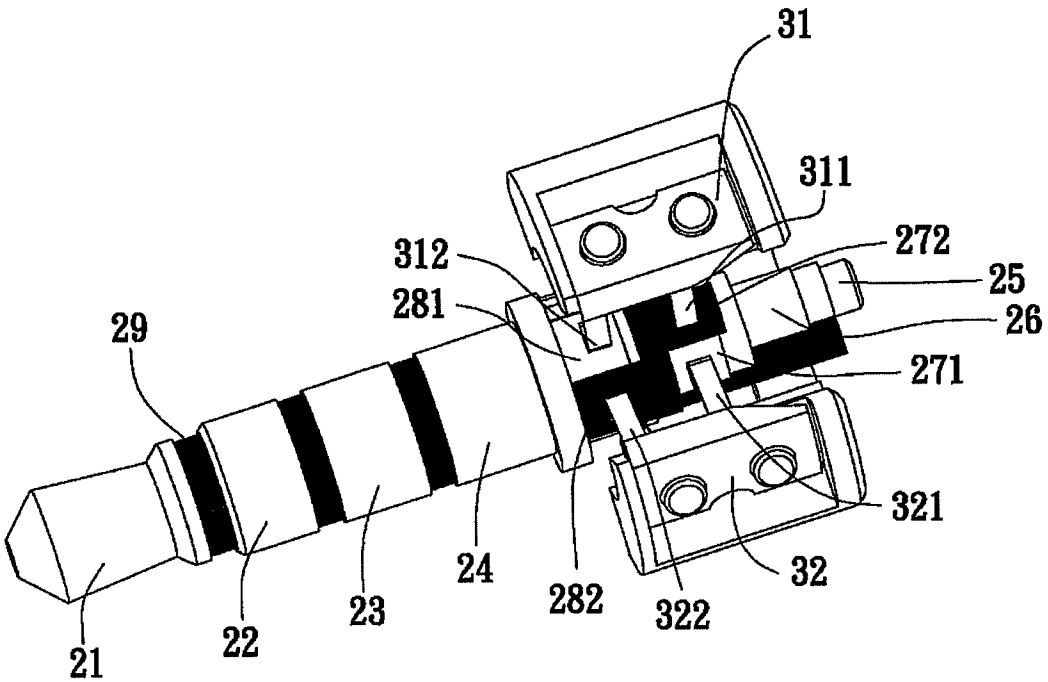
FIG. 6 is a schematic view of relative positions of the switch device and the terminal when the earphone plug according to the present invention is in the second mode.

If the switch sleeve 70 is rotated to the position as shown in FIG. 5, that is, when the mark "AT&T" corresponds to the reference point 61, the switch device 30 therein and the terminal 20 are in the relative positions as shown in FIG. 6. The switch device 30 is shifted along with the switch sleeve 70, and thus the first pin 311 of the first conductor 31 is shifted to contact with the insulation area 272 of the third signal interface 27, the second pin 312 is shifted to contact with the conduction area 281 of the fourth signal interface 28, the third pin 321 of the second conductor 32 is shifted to contact with the conduction area 271 of the third signal interface 27, and the fourth pin 322 is shifted to contact with the insulation area 282 of the fourth signal interface 28. Therefore, the first signal interface 21, the second signal interface 22, the third signal interface 23, and the fourth signal interface 24 in the external signal interfaces are respectively provided for transmitting the left channel signals, the right channel signals, the grounding signals, and the microphone signals, and thus the earphone plug is applicable to products of the AT&T system.

To sum up, the earphone plug applicable to different system specifications according to the present invention designs interlaced conduction areas and insulation areas on the signal interfaces on the terminal that are responsible for transmitting the microphone signals and the grounding signals, and combines with the switch device to extend the two conductors for interlaced contact and conduction on the interlaced conduction areas and insulation areas, so that the third signal interface and the fourth signal interface in the external signal interfaces of the terminal are enabled to transmit different signals in different modes. Thus, a mode-switching effect is achieved, and the earphone plug is compatible with both the OMTP system and the AT&T system and applicable to the mobile phones with different systems, so that functions such as music transmission and voice transmission can be effectively performed.

The above descriptions should only be regarded as examples and are not intended to limit the present invention. Any equivalent modifications or variations to the present invention without departing from the spirit and scope of the present invention should all be included within the scope of the following claims.

What is claimed is:

1. An earphone plug, comprising:

a terminal, having an external signal interface and an internal signal interface each having a plurality of signal interfaces adapted to transmit signals; and a switch device, combined with the terminal and having a first conductor and a second conductor, wherein, when the switch device is switched between a first mode and a second mode, the first conductor and the second conductor alternately contact with two of the signal interfaces to change the order of signals transmitted by the signal interfaces on the terminal, wherein in two of the plurality signal interfaces of the internal signal interface, each signal interface having a conduction area and an insulation area, and the conduction area and the insulation area are interlaced, wherein the first conductor has at least two pins and the second conductor has at least two pins, and wherein both the one pin of the first conductor and the one pin of the second conductor and both the other pin of the first conductor and the other pin of the second conductor alternately contact with the two signal interfaces having the conduction area and the insulation area in the internal signal interface.

2. The earphone plug according to claim 1, wherein the one pin of the first conductor and the one pin of the second conductor alternately contact with the conduction area and the insulation area of the third signal interface when the first mode is switched to the second mode, and the other pin of the first conductor and the other pin of the second conductor alternately contact with the conduction area and the insulation area of the fourth signal interface when the first mode is switched to the second mode.

3. The earphone plug according to claim 1, wherein the plurality of signal interfaces are isolated with each other by an insulation area.

4. The earphone plug according to claim 1, wherein the plurality of signal interfaces of the external signal interface and the internal signal interface respectively comprises a first signal interface, a second signal interface, a third signal interface, and a fourth signal interface, and the plurality of signal interfaces of the external signal interface and the internal signal interface are connected correspondingly to each other.

5. The earphone plug according to claim 4, wherein the two signal interfaces having the conduction area and the insulation area are the third signal interface and the fourth signal interface.

6. The earphone plug according to claim 5, wherein, in the first mode, the first signal interface is defined as the signal interface for left channel signals, the second signal interface is defined as the signal interface for right channel signals, the third signal interface is defined as the signal interface for microphone signals, and the fourth signal interface is defined as the signal interface for grounding signals.

7. The earphone plug according to claim 6, wherein the terminal in the first mode is applicable to an Open Mobile Terminal Platform (OMTP) system specification.

8. The earphone plug according to claim 5, wherein, in the second mode, the first signal interface is defined as the signal interface for the left channel signals, the second signal interface is defined as the signal interface for the right channel signals, the third signal interface is defined as the signal interface for the grounding signals, and the fourth signal interface is defined as the signal interface for the microphone signals.

9. The earphone plug according to claim 8, wherein the terminal in the second mode is applicable to an American Telephone and Telegraph (AT&T) system specification.

10. The earphone plug according to claim 4, further comprising a wire assembly, wherein the wire assembly has four wires, electrically connected to the first signal interface, the second signal interface, the first conductor, and the second conductor respectively.

11. The earphone plug according to claim 10, further comprising an internal module wrapping the terminal and the wire assembly, wherein an opening is disposed on a part of the internal module wrapping the terminal to expose the third signal interface and the fourth signal interface in the internal signal interface.

12. The earphone plug according to claim 11, wherein the switch device is of ring-shape and sleeved on the internal module, and the first conductor and the second conductor contact with the third signal interface and the fourth signal interface through the opening.

13. The earphone plug according to claim 12, further comprising an external module and a switch sleeve, wherein the external module wraps the wire assembly and a part of the internal module, and the external module and the switch sleeve are sleeved on the internal module from opposite sides to be combined with the switch device.

14. The earphone plug according to claim 13, wherein a reference point is disposed on the external module, a first mode mark and a second mode mark are respectively marked on the switch sleeve, in the first mode, the first mode mark corresponds to the reference point, and when the switch sleeve is rotated to the second mode, the second mode mark corresponds to the reference point in place of the first mode mark.

* * * * *